US005431832A

United States Patent [19]

Crowe et al.

[11] Patent Number: 5,431,832

[45] Date of Patent: Jul. 11, 1995

[54] NON-HYDROGEN EVOLVING SILOXANE-BASED LUBRICANT COMPOSITION

[76] Inventors: Angela M. Crowe, Rte. 2, Box 260 B, Winder, Ga. 30680; David M. Freedman, 1882 Skidmore Cir., Lawrenceville, Ga. 30244; Joyce A. Rodriguez, 461 Yarbrough-Ridgeway Rd., Maysville, Ga. 30558; Joseph J. Fanelli, 8695 Colony Club Dr., Alpharetta, Ga. 30202

[21] Appl. No.: 96,336

[22] Filed: Jul. 23, 1993

[51] Int. Cl.[6] ..... C10M 107/50; B28B 7/36

[52] U.S. Cl. ..... 252/49.5; 252/49.6; 106/38.22

[58] Field of Search ..... 252/49.5, 49.6; 106/38.22

[56] References Cited

U.S. PATENT DOCUMENTS

| | | | |
|---|---|---|---|
| Re. 32,318 | 12/1986 | Comper et al. | 106/38.22 |
| 3,532,624 | 10/1970 | Cekada, Jr. | 252/49.6 |
| 3,713,851 | 1/1973 | Cekada, Jr. | 106/38.22 |
| 3,872,038 | 3/1975 | Adams et al. | 106/38.22 |
| 3,905,823 | 9/1975 | Piskoti | 106/38.22 |
| 3,967,968 | 7/1976 | Stone et al. | 252/49.5 |
| 4,039,143 | 8/1977 | Brown et al. | 252/28 |
| 4,066,560 | 1/1978 | VanVleck et al. | 252/49.5 |
| 4,244,742 | 1/1981 | Huber et al. | 106/38.22 |
| 4,325,852 | 4/1982 | Hallenbeck | 523/334 |
| 4,359,340 | 11/1982 | Comper et al. | 252/49.5 |
| 4,387,196 | 6/1983 | Bonnet et al. | 525/477 |
| 4,431,452 | 2/1984 | Comper et al. | 106/38.22 |
| 4,454,262 | 6/1984 | Fukayama et al. | 523/210 |
| 4,509,984 | 4/1985 | Scheiderich et al. | 106/38.22 |
| 4,533,305 | 8/1985 | Comper et al. | 106/38.22 |
| 4,534,928 | 8/1985 | Martin | 106/38.22 |
| 4,547,544 | 10/1985 | Allardice | 106/38.22 |
| 4,554,122 | 11/1985 | Allardice | 106/38.22 |
| 4,636,407 | 1/1987 | Comper et al. | 427/133 |
| 4,678,815 | 7/1987 | Hoffman | 523/122 |
| 4,840,742 | 6/1989 | Hoffman | 252/49.5 |
| 4,863,650 | 9/1989 | Kohler et al. | 106/38.22 |
| 4,889,677 | 12/1989 | Hashimoto et al. | 252/49.5 |
| 4,889,770 | 12/1989 | Ona et al. | 428/447 |
| 5,073,608 | 12/1991 | Ona et al. | 525/477 |
| 5,152,950 | 10/1992 | Ona et al. | 264/315 |

*Primary Examiner*—Jerry D. Johnson

*Attorney, Agent, or Firm*—Paul J. Juettner; John A. Shedden; Katherine L. Stewart

[57] ABSTRACT

A siloxane-based lubricant composition contains a mixture of nonreactive and reactive polydimethylsiloxanes, crosslinker and sufficient amounts of surfactant and water to provide an emulsion. The composition contains no methyl hydrogen silane, dimethyl hydrogen silane and/or polymethyl hydrogen siloxane and therefore releases no hydrogen gas during storage or during use.

15 Claims, No Drawings

NON-HYDROGEN EVOLVING SILOXANE-BASED LUBRICANT COMPOSITION

BACKGROUND OF THE INVENTION

This invention relates to a siloxane-based lubricant composition and in particular, to such a composition which is useful for coating a tire curing bladder as part of a tire manufacturing operation.

In the manufacture of a pneumatic rubber vehicle tire, shaping of the tire is accomplished by inflating a rubber bag, or curing bladder, inside a green tire carcass thereby forcing the tire against the mold surface. Generally, there is considerable relative movement between the outer surface of the bladder and the inner surface of the green tire during the expansion phase of the bladder prior to fully curing the tire. Similarly, there is also considerable relative movement between the bladder and the cured tire after the tire has been molded and vulcanized and the bladder has been collapsed and stripped from the inner surface of the tire in order to reduce friction between the bladder and the inside of the tire and provide optimum slip of the bladder during the shaping process when the raw tire and bladder are in relative movement with respect to each other.

A tire curing bladder lubricant, intended to be applied as a coating on the surface of the bladder, is disclosed in U.S. Pat. No. Re. 32,318. The lubricant includes (A) from about 20 to about 40 parts by weight of a polydimethylsiloxane having a viscosity of from about 12 to about 28 million centistokes at 25° C., (B) from about 35 to about 70 parts by weight of at least one silane selected from (i) a methyl hydrogen silane having a viscosity of from about 20 to about 40 centistokes at 25° C., (ii) a dimethyl hydrogen silane having a viscosity of from about 80 to about 120 centistokes at 25° C. and (iii) a methyltrimethoxy silane, (C) optionally, from about 3 to about 2 parts weight of a metal salt of an organic acid, (D) from about 10 to about 25 parts by weight of one or more surfactants and (E) from about 500 to about 1500 parts by weight of water to provide an emulsion or dispersion. The patent indicates a preference for a hydroxyl-capped polydimethylsiloxane for (A) and a mixture of methyl hydrogen silane and dimethyl hydrogen silane as (B) in the foregoing lubricant.

While the lubricant of U.S. Pat. No. Re. 32,318 containing methyl hydrogen silane has been found to be effective for its intended purpose, it has been observed that during storage and/or use in a tire curing operation, potentially hazardous hydrogen gas is given off as a result of the decomposition of the methyl hydrogen silane levels.

SUMMARY OF THE INVENTION

It has now been discovered that by excluding the presence of methyl hydrogen silane, dimethyl hydrogen silane and/or polymethyl hydrogen siloxane and by employing a mixture of nonreactive and reactive polydimethylsiloxanes together with a small amount of a crosslinker, a lubricant composition especially adapted for use as a tire bladder release coating is obtained which evolves no hydrogen on storage and/or in use and which on curing provides effective and durable lubrication/release properties between contacting surfaces.

Thus, in accordance with the present invention, there is provided a non-hydrogen evolving lubricant composition containing no methyl hydrogen silane, dimethyl hydrogen silane and/or polymethyl hydrogen siloxane and comprising:

(a) at least one nonreactive polydimethylsiloxane possessing a viscosity of from about 50 to about 30 million centistokes at 25° C.;

b) at least one reactive polydimethylsiloxane possessing a viscosity of from about 15 to about 5 million centistokes at 25° C.;

c) at least one crosslinker;

d) at least one surfactant; and, e) water, with nonreactive polydimethylsiloxane (a) being present at a level of from about 20 to about 95 percent by weight of combined nonreactive polydimethylsiloxane (a) and reactive polydimethylsiloxane (b), reactive polydimethylsiloxane (b) being present at a level of from about 5 to about 80 percent by weight of combined nonreactive polydimethylsiloxane (a) and reactive polydimethylsiloxane (b), crosslinker (c) being present at a level of from about 0.01 to about 5 percent by weight of reactive polydimethylsiloxane (b) and surfactant (d) and water (e) being present in amounts sufficient to provide an emulsion.

In the foregoing formulation, nonreactive polydimethylsiloxane (a) and reactive polydimethylsiloxane (b) must both be present in order to provide a lubricant composition possessing effective lubrication/release and durability properties, the latter being understood as the ability of a single application of lubricant composition to provide effective lubrication/release through several tire production cycles, e.g., up to five of such cycles, without the need for a fresh application of lubricant composition.

DESCRIPTION OF THE PREFERRED EMBODIMENTS

Nonreactive polydimethylsiloxane (a) possesses a viscosity of from about 50 to about 30 million centistokes and is advantageously made up of a mixture of high viscosity nonreactive polydimethylsiloxane(s) (i) which contribute to the durability of the lubricant composition and low and/or medium viscosity nonreactive polydimethylsiloxane(s) (ii) which contribute to its lubricity. Where nonreactive polydimethylsiloxane (a) is made up of such a mixture, high viscosity siloxane (i) will generally possess a viscosity of at least 100,000, and preferably from about 10 million to about 25 million, centistokes at 25° C. and low-to-medium viscosity siloxane (ii) will generally possess a viscosity of less than 100,000 centistokes at 25° C., e.g., from about 50 to about 200 centistokes at 25° C. in the case of a low viscosity siloxane and from about 10,000 to about 50,000 centistokes at 25° C. in the case of a medium viscosity siloxane. Of course, mixtures of low and medium viscosity siloxanes can be used as nonreactive polydimethylsiloxane component (ii). The weight ratio of high viscosity polydimethylsiloxane(s) (i) to low-to-medium viscosity polydimethylsiloxane(s) (ii) can vary from about 1:10 to about 10:1 and preferably from about 1:5 to about 5:1. Nonreactive polydimethylsiloxane(s) (a) will be present in the lubricant composition at a level of from about 20 to about 95, and preferably from about 40 to about 75, weight percent of the total weight of nonreactive polydimethylsiloxane (a) and reactive polydimethylsiloxane (b).

Specific high viscosity nonreactive polydimethylsiloxanes (i) for use herein include Rhodorsil Emulsion M-405 of Rhone-Poulenc Inc., a siloxane emulsion whose siloxane component possesses a nominal viscosity of greater than 100,000 centistokes at 25° C., Silicone 2068 of the General Electric Co., a siloxane emulsion whose siloxane component possesses a nominal viscosity of greater than 100,000 centistokes at 25° C., L45-300,000 of Union Carbide Corp. which possesses a nominal viscosity of 300,000 centistokes at 25° C. and PS050 of Hüls America, Inc. which possesses a nominal viscosity of 2.5 million centistokes at 25° C.

Specific low-to-medium viscosity nonreactive polydimethylsiloxanes (ii) for use herein include Rhodorsil Fluid H47V100 of Rhone-Poulenc Inc. which possesses a nominal viscosity of 100 centistokes at 25° C., PS041 and PS047 of Hüls America, Inc. possessing nominal viscosities of 100 and 30,000 centistokes at 25° C., respectively, Dow 200 of Dow-Corning Corp. possessing a nominal viscosity of 200 centistokes at 25° C. and L45-100 of Union Carbide Corp. possessing a nominal viscosity of 100 centistokes at 25° C.

Reactive polydimethylsiloxane component (b) can be selected from amongst any of the hydroxyl and/or alkoxy terminated polydimethylsiloxanes possessing a viscosity of from about 15 to about 5 million, and preferably from about 50 to about 10,000, centistokes at 25° C. Specific reactive polydimethylsiloxanes (b) that can be used herein with generally good results include hydroxyl-terminated polydimethylsiloxanes L-9000 of Union Carbide Corp. (1,000 centistokes at 25° C.), PS-340, PS-343.8 and PS-349.5 of Hüls America, Inc. (15-35, 3500 and 800,000-1.2 million centistokes at 25° C., in that order), DCQ13563, DCQ2-7132 and DC-109 of Dow Corning Corp. (100, 1800 and 5,000 centistokes at 25° C., in that order) and combinations of these and similar reactive polydimethylsiloxanes. In general reactive polydimethylsiloxane component (b) can be present at a level of from about 5 to about 80, and preferably from about 25 to about 60, weight percent of combined nonreactive polydimethylsiloxane(s) (a) and reactive polydimethylsiloxane(s) (b).

Crosslinker component (c) can be selected from among any of the known and conventional compounds useful for crosslinking reactive polydimethylsiloxane component (b), e.g., those described in U.S. Pat. No. 4,889,770 the contents of which are incorporated by reference herein. Known and conventional crosslinkers include organotrialkoxysilanes, organotriacyloxysilanes, organotrioximesilanes and tetraalkyl silicates. The alkyltrialkoxysilanes are preferred for use herein and of these, methyltrimethoxysilane is especially preferred.

Upon application of the lubricant composition to the tire curing bladder (or other surface), crosslinker component (c) reacts with the terminal hydroxyl and/or alkoxy groups of reactive polydimethylsiloxane component (b) to crosslink the latter and provide an adherent film. The crosslinking reaction requires only small amounts of crosslinker, e.g., from about 0.01 to about 5, and preferably from about 0.02 to about 2, percent by weight of reactive polydimethylsiloxane (b), and can take place in the presence or absence of added catalyst (although the reaction may in some situations be catalyzed by a component of the tire curing bladder to which the lubricant composition is applied).

Any of the surfactants heretofore employed in the manufacture of a tire curing bladder adhesive composition can also be used herein. Examples of suitable surfactants which can be employed in the adhesive compositions of this invention are anionic, cationic and nonionic surfactants such as alkyl or aryl polyglycol ethers or alkylphenyls such as polyoxyethylene alkyl phenyls, polyoxyethylene sorbitan hexastearate, polyoxyethylene isodecyl ether, trimethylnonyl ether of polyethylene glycol containing from 3 to 15 ethylene oxide units per molecule, polyoxyethylene sorbitan oleate having a saponification number of from 102 to 108 and a hydroxyl number of from 25 to 35, polyoxyethylene cetylstearyl ethers, etc.

The amounts of surfactant and water employed can vary considerably provided, of course, an emulsion is obtained. Stable emulsions can contain from about 2 to about 50, and preferably from about 5 to about 40, percent by weight of combined components (a), (b) and (c), from about 0.5 to about 5, and preferably from about 1 to about 4, percent by weight of surfactant(s) (d) and from about 50 to about 95, and preferably from about 60 to about 90, percent by weight of water. The aqueous emulsion can be readily prepared employing known and conventional procedures and equipment.

The lubricant composition of this invention can also contain one or more optional ingredients such as polymeric film formers, e.g., of the acrylic variety, catalysts for the crosslinking reaction, additional lubricants and slip agents, air bleed agents, defoaming agents, thickeners, fillers, stabilizers, preservatives, e.g., biocides, etc., in the widely varying amounts, e.g., from 0.2 to as much as 50 weight percent of the composition.

The lubricant composition can be applied by spraying, brushing, wiping, painting or any other method which applies an even coat over the tire curing bladder. The composition can then be cured on the bladder either on standing for at least 10 hours at room temperature or, advantageously, by being subjected to the temperatures reached during the curing and vulcanization of the tire carcass in the tire apparatus. These temperatures typically reach from about 175° F. to about 350° F. with curing taking place within about 20 minutes or less. Once curing has occurred, the lubricant composition continues to adhere to the surface of the bladder through repetitive sequences of expansion-contraction thus allowing a single application of lubricant to provide effective lubrication/release performance for several tire production cycles.

The following examples are illustrative of tire curing bladder lubricant compositions in accordance with the present invention.

EXAMPLE 1

This example illustrates the lubricant composition of this invention to which several optional ingredients have been added.

| Component | Weight Percent |
|---|---|
| Low viscosity nonreactive polydimethyl siloxane[1] | 7.48 |
| Mixture of polyoxyethylene cetyl-stearyl ethers[2] | 1.19 |
| Hydroxyterminated polydimethyl siloxane[3] | 4.76 |
| Methyltrimethoxysilane | 0.05 |
| Water, distilled | 59.50 |
| Defoamer[4] | 0.10 |
| Biocide[5] | 0.10 |
| Xanthan gum | 0.46 |
| Polyoxythylated isodecyl alcohol[6] | 0.92 |
| Hydroxyacetic acid | 0.14 |
| High viscosity nonreactive polydimethyl siloxane[7] | 21.00 |

-continued

| Component | Weight Percent |
|---|---|
| Acrylic latex film-forming resin[8] | 4.30 |
| Total | 100.00 |

[1]Rhodorsil Fluid H47V100 (Rhone-Poulenc) having a nominal viscosity of 100 centistokes at 25° C. centistokes at 25° C.
[2]Ethal CSA-3, 2.20 weight percent, and Ethal CSA-17, 1.30 weight percent (Ethox Chemicals) both of which are surfactants.
[3]Dihydroxy-terminated polydimethylsiloxane Fluid Q1-3563 (Dow-Corning) having a nominal viscosity of 85 centistokes at 25° C.
[4]Foamex AD100 (Rhone-Poulenc), a polydimethylsiloxane defoaming agent.
[5]Proxel GXL (Zeneca), a preservative.
[6]Emulphogene DA-530 (Rhone-Poulenc), a surfactant.
[7]Emulsion M-405 (Rhone-Poulenc), a polydimethylsiloxane emulsion..
[8]WRL-01197 (Rhone-Poulenc), an acrylic latex.

The foregoing lubricant composition was prepared by adding the low viscosity nonreactive polydimethylsiloxane and the polyoxyethylene cetyl-stearyl esters together and heating to 130° F. and mixing at medium speed for 20 minutes. The hydroxyl-terminated polydimethylsiloxane and the methyltrimethoxysilane were then added followed by mixing for 15 minutes. Thereafter, 11.7 weight percent of the total water was heated to 125° F. and added to the mixture followed by further mixing for 20 minutes. The mixture was then cooled to 100° F., homogenized twice at 2500 psi and 22.8 weight percent of the total water was added to the mixture followed by mixing at medium speed for 30 minutes. The remaining water was charged to a separate vessel, the biocide and defoamer added thereto and the contents of the vessel were mixed for 10 minutes. The xanthan gum and polyoxyethylated isodecyl alcohol were charged to yet another vessel, mixed for 10 minutes and then added to the vessel containing the water, biocide and defoamer. Following another 20 minutes of mixing, the hydroxyacetic acid was added, then the high viscosity nonreactive polydimethylsiloxane and, finally, the homogenized mixture. After mixing the combined batch for 15 minutes at medium speed, the acrylic latex was added and the batch was given a final mixing of 30 minutes.

EXAMPLE 2

Employing substantially the same procedure as described in Example 1, the following lubricant composition was prepared.

| Component | Weight Percent |
|---|---|
| Low viscosity nonreactive polydimethyl siloxane of Example 1 | 6.60 |
| Mixture of polyoxyethylene cetyl-stearyl ethers of Example 1 | 1.05 |
| Hydroxyterminated polydimethyl siloxane of Example 1 | 4.20 |
| Methyltrimethoxy silane of Example 1 | 0.04 |
| Water, distilled | 63.01 |
| Defoamer of Example 1 | 0.10 |
| Biocide of Example 1 | 0.10 |
| Mixture of polyoxyethylene cetyl-stearyl ethers[9] | 1.52 |
| Hydroxyacetic acid | 0.08 |
| High viscosity nonreactive polydimethyl siloxane[10] | 19.00 |
| Acrylic latex film forming resin of Example 1 | 4.30 |
| Total | 100.00 |

[9]Ethal CSA-3 and Ethal CSA-17, 0.96 and 0.56 by weight percent, respectively.
[10]GE Silicone 2068 (General Electric Company), a polydimethylsiloxane.

What is claimed is:

1. A non-hydrogen evolving siloxane-based lubricant composition containing no methyl hydrogen silane, dimethyl hydrogen silane and/or polymethyl hydrogen siloxane comprising:

(a) at least one nonreactive polydimethylsiloxane possessing a viscosity of from about 50 to about 30 million centistokes at 25° C.;

b) at least one hydroxy and/or alkoxy terminated reactive polydimethylsiloxane possessing a viscosity of from about 15 to about 5 million centistokes at 25° C.;

c) at least one crosslinker;

d) at least one surfactant; and, e) water, with nonreactive polydimethylsiloxane (a) being present at a level of from about 20 to about 95 percent by weight of combined nonreactive polydimethylsiloxane (a) and reactive polydimethylsiloxane (b), reactive polydimethylsiloxane (b) being present at a level of from about 5 to about 80 percent by weight of combined nonreactive polydimethylsiloxane (a) and reactive polydimethylsiloxane (b), crosslinker (c) being present at a level of from about 0.01 to about 5 percent by weight of reactive polydimethylsiloxane (b) and surfactant (d) and water (e) being present in amounts sufficient to provide an emulsion.

2. The lubricant composition of claim 1 wherein nonreactive polydimethylsiloxane (a) contains at least one nonreactive polydimethylsiloxane (i) possessing a viscosity of at least 100,000 centistokes at 25° C. and at least one nonreactive polydimethylsiloxane (ii) possessing a viscosity of less than 100,000 centistokes at 25° C.

3. The lubricant composition of claim 2 wherein nonreactive polydimethylsiloxane (i) possesses a viscosity of from about 10 to about 25 million centistokes at 25° C. and nonreactive polydimethylsiloxane (ii) is selected from the group consisting of nonreactive polydimethylsiloxanes possessing a viscosity of from about 50 to about 200 centistokes at 25° C., nonreactive polydimethylsiloxanes possessing a viscosity of from about 10,000 to about 50,000 centistokes at 25° C. and combinations thereof.

4. The lubricant composition of claim 2 wherein the weight ratio of nonreactive polydimethylsiloxane (i) to nonreactive polydimethylsiloxane (ii) is from about 1:10 to about 10:1.

5. The lubricant composition of claim 2 wherein the weight ratio of nonreactive polydimethylsiloxane (i) to nonreactive polydimethylsiloxane (ii) is from about 1:5 to about 5:1.

6. The lubricant composition of claim 2 wherein the weight ratio of nonreactive polydimethylsiloxane (i) to nonreactive polydimethylsiloxane (ii) is from about 1:10 to about 10:1.

7. The lubricant composition of claim 3 wherein the weight ratio of nonreactive polydimethylsiloxane (i) to nonreactive polydimethylsiloxane (ii) is from about 1:5 to about 5:1.

8. The lubricant composition of claim 1 wherein crosslinker (c) possesses a viscosity of from about 50 to about 10,000 centistokes at 25° C.

9. The lubricant composition of claim 1 wherein crosslinker (c) is selected form the group consisting of organotrialkoxysilane, organotriacyloxysilane, tetraalkyl silicate and combinations thereof.

10. The lubricant composition of claim 1 wherein crosslinker (c) is methyltrimethoxysilane.

11. The lubricant composition of claim 1 wherein nonreactive polydimethylsiloxane (a) is present in the lubricant composition at a level of from about 40 to about 75 weight percent of the total weight of nonreactive polydimethylsiloxane (a) and reactive polydimethylsiloxane (b), reactive polydimethylsiloxane (b) is present at a level of from about 25 to about 60 weight percent of the total weight of nonreactive polydimethylsiloxane (a) and reactive polydimethylsiloxane (b) and crosslinker (c) is present at a level of from about 0.02 to about 2 percent by weight of reactive polydimethylsiloxane (b).

12. The lubricant composition of claim 1 containing a polymeric film former.

13. The lubricant composition of claim 12 wherein the polymeric film former is an acrylic film former.

14. The lubricant composition of claim 1 containing at least one additional component distinct from the components a), b), c), d), and e), in the aforementioned claim selected from the group consisting of a crosslinking catalyst, a lubricant in addition to that recited in the aforementioned claim, air bleed agent, defoaming agent, thickening agent which functions as a thickener, filler or stabilizer, preservative and combinations thereof.

15. The lubricant composition of claim 14 containing a polymeric film former.

* * * * *